United States Patent [19]

Kempton

[11] 4,171,016

[45] Oct. 16, 1979

[54] WATER REMOVAL SYSTEM FOR GAS WELLS

[76] Inventor: Edward A. Kempton, 336-41st Ave. NE., Calgary, Alberta, Canada

[21] Appl. No.: 875,244

[22] Filed: Feb. 6, 1978

[30] Foreign Application Priority Data

Dec. 19, 1977 [CA] Canada ..... 293399

[51] Int. Cl.[2] ..... E21B 43/00

[52] U.S. Cl. ..... 166/68; 166/54; 166/105; 417/196

[58] Field of Search ..... 166/68, 54, 105; 417/178, 190, 196

[56] References Cited

U.S. PATENT DOCUMENTS

| | | | |
|---|---|---|---|
| 1,758,376 | 5/1930 | Sawyer | 166/68 |
| 1,956,157 | 4/1934 | Morris | 166/54 |
| 3,494,296 | 2/1970 | Gluntz | 417/196 |
| 3,887,060 | 6/1975 | Canfield | 166/68 |
| 3,941,510 | 3/1976 | Morgan | 166/68 |

*Primary Examiner*—William Pate, III

*Attorney, Agent, or Firm*—Shlesinger, Arkwright, Garvey & Dinsmore

[57] ABSTRACT

Water, with gas entrained therein, collecting in the bottom of the casing of a gas producing well is continuously removed using an ejector in the inner of a pair of coaxial tubes mounted in the casing by continuously pumping drive water downwardly between the two tubes, radially inwardly through apertures in a nozzle body and upwardly through a nozzle at the top of the nozzle body into a suction chamber to draw water from an inlet duct at the bottom end of the inner tube through longitudinally extending passages in the nozzle body; the resulting mixture of drive water, well water and gas being discharged through a multi-stage diffuser and the inner tube to a separator, where the gas and water are separated. The separated gas can be used to operate a gas engine for driving the pump, which feeds drive water to the ejector, and the well water can be re-used as drive water.

7 Claims, 5 Drawing Figures

WATER REMOVAL SYSTEM FOR GAS WELLS

FIELD OF INVENTION

This invention relates to a pump system, and in particular to a water removal system for gas wells.

The build-up of water in gas producing wells is common. When water build-up occurs, the flow of gas decreases because the gas must pass through the water to enter the well. The following example provides ample evidence of the problem. A typical gas well in Western Canada may be drilled to approximately 2400 feet below ground level, and cased with a 6 inch casing. The top of the casing is capped. A 2350 feet length of 2⅜ inch outer diameter tubing is installed in the 6 inch casing, passes through the well cap and is connected via piping to a gas processing plant.

Gas flows into the well through perforations in the casing at the 2300 foot level and passes through the smaller tubing to the processing plant. Initial gas pressures and velocities may be quite high, e.g. 1,000 p.s.i. Due to the high velocity, little heat is lost in the smaller tubing, and water entrained in the gas is carried out of the well by the gas. When the gas pressure becomes lower, e.g. 300 p.s.i., gas velocity decreases to the point where the gas no longer carries entrained water to the surface. Moreover, because the gas is present in the 2⅜ inch diameter tube for a longer period of time, the temperature of the gas decreases and additional water condenses and flows down the tube into the casing.

In time, the water level rises in the casing and, after covering the perforations, creates a back pressure against inflowing gas. Thus, the gas flows into the well at reduced velocity causing higher water deposits. If the water reaches a level where the back pressure on the perforations is 300 p.s.i. (a water column of approximately 693 feet), very little gas flow can take place. Gas flow varies almost directly with differential pressure, and consequently maximum gas flow can be achieved only by maintaining the water level in the casing below the perforations.

BACKGROUND OF THE INVENTION

Conventional methods of water removal includes a reciprocating down-hole pump actuated by rods from a working head mounted at the well head. Gas flows from the well cap, and water is pumped out of the well at regular intervals of time, i.e. on a time cycle. The pump may operate for a period of time and be stopped for a second period of time. The pump would be damaged if no water was present. Accordingly, the operating and shut down times of the pump must be so calculated as to permit water to rise to a predetermined level (usually estimated) before the pump is operated to lower the water to an acceptable, estimated level.

Accurate water levels are rarely known and often the well will be pumped to a level where no water enters the pump, resulting in damage to the latter. In order to prevent such damage, the time cycle is so chosen as to ensure that there is water in the pump at all times during operation thereof. During the time when the pump is not operating, water rises in the casing, covering the perforations and creating a back pressure, which reduces gas production. With such a hit-and-miss method, there is a distinct possibility of damage to the pumping unit, in which case it is necessary to remove the rods and pump and repair and re-install the unit. No gas is produced while repairs are being made. In an effort to reduce the possibility of pump failure due to a lack of water, a water level differential in the well may be as much as 100 feet, say from 20 feet above the pump to 120 feet above the pump, consequently, gas production is reduced by an average of 70 feet head of water, or 30 p.s.i. back pressure on the perforations.

The initial cost of the equipment described above may be as high as $30,000.00. In the case of low production wells, an investment of this magnitude added to repair costs may make it uneconomical to produce gas and the well is shut-in (closed).

At present, there are many wells which have been "shut-in" for this reason.

Thus, it is readily apparent that there is a need for an efficient system for the removal of water from a gas producing well. One system for removing water from a gas well is disclosed by U.S. Pat. No. 2,061,865, which issued to W. T. Wells on Nov. 24, 1936. The system proposed by Wells relies on a compressor for forcing air into the well when a pressure gauge at the surface indicates a reduction in flow pressure due to the ingress of water into the well. The air is driven under pressure through a Venturi located at the bottom end of tubing mounted in the casing for drawing water out of the well casing. The gauge must be monitored and incorporated into an automated valve system with the electrical and pneumatic controls necessary to operate the apparatus, i.e. to start the engine or motor for driving the compressor in response to the reduced gas pressure. Because the system is switched on and off in accordance with the ingress of water into the well, i.e. operation is intermittent, gas production cannot be at a maximum. Moreover, the Wells system relies on a complicated packer with built-in check valves for controlling air and/or water or gas flow.

Thus, there still exists a need for a simple system for the efficient removal of water from a gas producing well.

SUMMARY OF THE INVENTION

The object of the present invention is to provide a relatively simple water removal system, which effectively maintains the water level in a well at a predetermined level, so that gas production is not affected by the ingress of water into the well.

Accordingly, the present invention relates to a pump system for use in a well of the type including a casing defining the wall of the well, a cap on said casing defining the well head, and perforations in said casing near the bottom end thereof for introducing a well fluid into the casing, said system comprising inlet tubing within said casing extending from beneath said perforations through said cap at the well head for introducing a drive fluid into the well, outlet tubing within said inlet tubing extending from the well head downwardly beneath the bottom end of said inlet tubing into the casing for carrying well fluid to the well head; sealing means between the bottom end of said inlet tubing and said outlet tubing for preventing the passage of well fluid between said inlet and outlet tubing; a first valve in the bottom end of said outlet tubing for admitting well fluid into said outlet tubing; a foot valve in said outlet tubing above said first valve permitting upward flow and preventing downward flow of well fluid in said outlet tubing; an ejector device in said outlet tubing above said foot valve for mixing said well fluid with said drive fluids and directing said fluids upwardly to the well head; and pump means for continuously pumping said drive fluid into the space between said inlet and outlet tubing and through said ejector device for mixing with said well fluid to carry the well fluid to the well head.

More specifically, the invention relates to a water removal pump system for gas wells of the type including a casing defining the wall of the well, a cap on the casing defining the well head, perforations in said casing near the bottom end thereof permitting the entry of gas into the casing and an outlet duct in said cap for discharging gas from the casing, said system comprising inlet tubing within said casing extending from beneath the perforations through said cap at the well head for introducing drive water into the well; outlet tubing within said inlet tubing extending through the cap at the well head downwardly beneath the bottom end of said inlet tubing into the casing for carrying well water introduced into the casing with the gas to the well head; sealing means between the bottom end of said inlet tubing and said outlet tubing for preventing the passage of well water and gas between said inlet and outlet tubing; a first valve in the bottom end of said outlet tubing for admitting well water into said outlet tubing; a foot valve in said outlet tubing above said first valve permitting upward flow and preventing downward flow of well water in said outlet tubing; an ejector device in said outlet tubing above said foot valve for mixing drive water and said well water and any gas contained therein, and directing said drive water, well water and gas upwardly to the well head; and pump means for continuously pumping said drive water into the passage between said inlet and outlet tubing and through said ejector device for mixing with said well water to carry the well water to the well head.

It is worth noting that the system of the present invention is in continuous operation, maintaining the water level at a predetermined level below the perforations in the well casing, whereby maximum gas production is achieved. Moreover, the system of this invention does not rely for success on complicated packer assemblies or gauges.

BRIEF DESCRIPTION OF THE DRAWINGS

The invention will now be described in greater detail with reference to the accompanying drawings, which illustrate a preferred embodiment of the invention, and wherein.

DESCRIPTION OF THE PREFERRED EMBODIMENT

Figure 1:
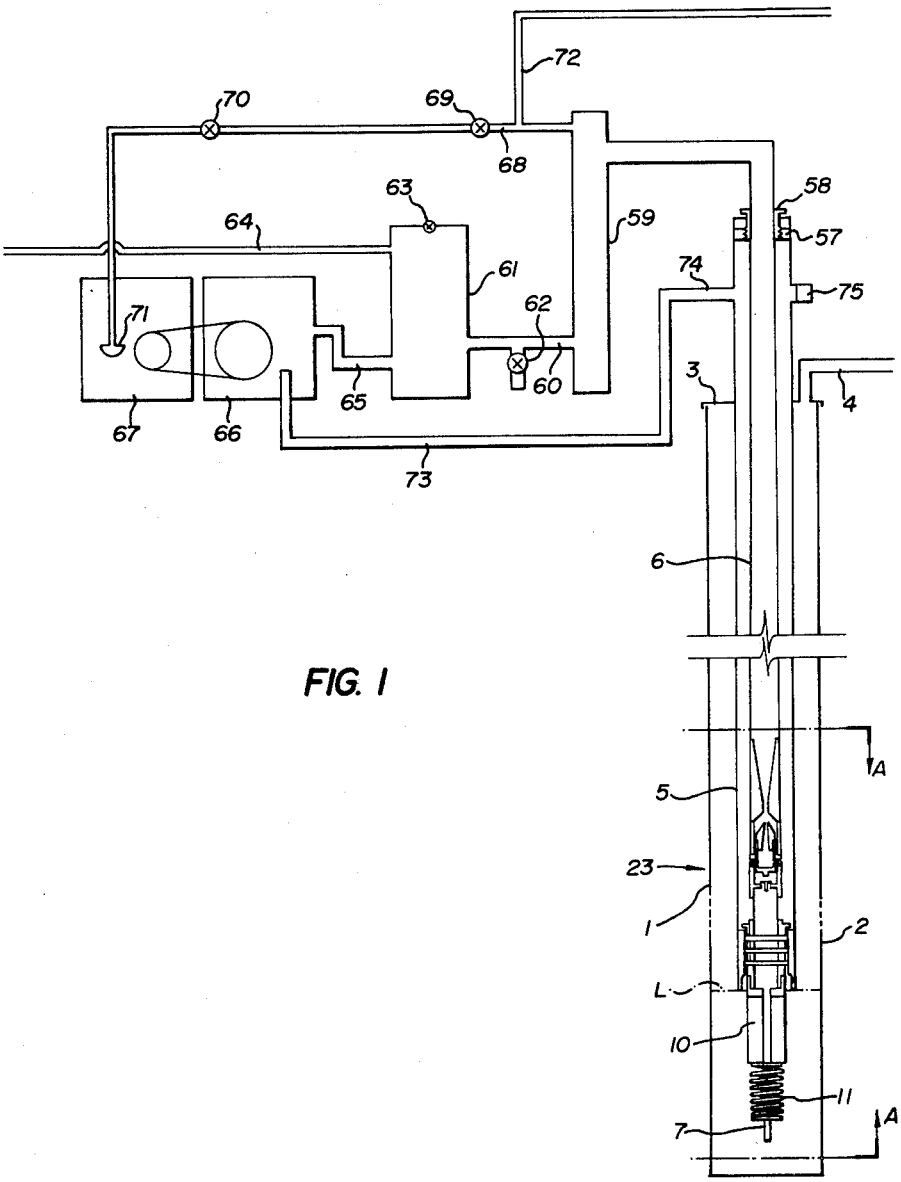
FIG. 1 is a schematic view of a pump system in accordance with the present invention.
Figure 2A:
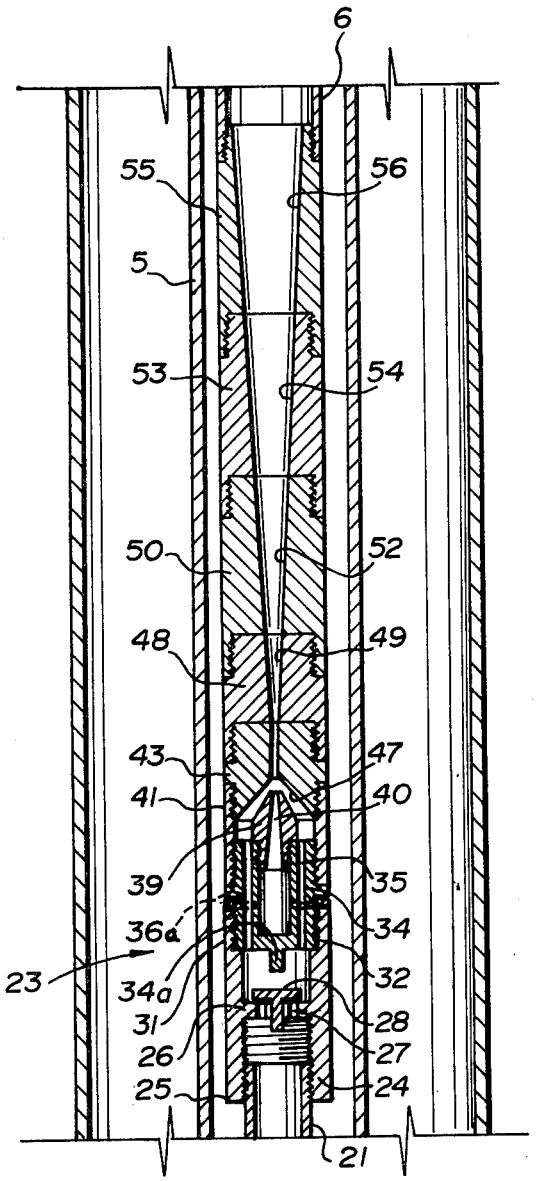
FIGS. 2*a* and 2*b* are schematic longitudinal-sectional views of portion A—A of FIG. 1 on a larger scale.
Figure 2B:
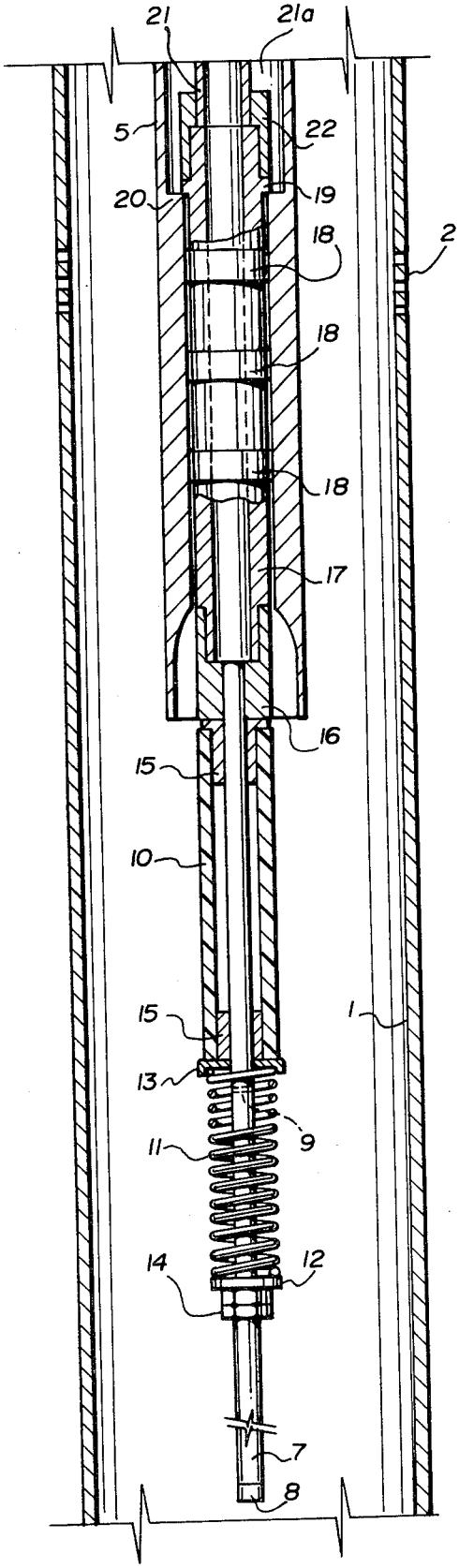

With reference to FIGS. 1 and 2, the system of the present invention is used in a well including a casing 1, with perforations 2 above its bottom end through which gas enters the casing. The casing 1 is provided with a cap 3, and gas is discharged from the casing 1 for further processing via an outlet duct 4 in the cap 3.

During normal operation, water enters the casing 1 via the perforation 2 with the gas. If the pressure of the gas is sufficiently high, the gas with entrained water is discharged via the outlet duct 4. When the pressure drops, the water settles to the bottom of the casing and eventually covers the perforations 2 reducing if not stopping gas flow through the perforations.

The system of the present invention maintains the water level at a predetermined level L (FIG. 1), and thus maintains gas production at a maximum level for the individual well. The system includes inlet tubing 5 extending downwardly into the casing 1 beyond the perforations 2. The tubing 5 is coaxial with the casing 1 and with outlet tubing 6 within the inlet tubing. The bottom end of the outlet tubing 6 is defined by an inlet duct 7, with a bottom plug 8 and inlet apertures 9 through which well water and any gas entrained there can enter the outlet tubing. The apertures 9 are normally closed by a float 10, which is in the form of a sleeve coaxial with and slidably mounted on the inlet duct 7. The float 10 is formed of a solid nylon material of greater specific gravity than water. Thus, a helical spring 11 is mounted on the inlet duct 7 beneath the float to support the weight of the latter in the dry condition. The spring 11 retains the float 10 in a rest position covering the apertures 9. End caps 12 and 13 are provided below and above the spring 11 on the duct 7, and nuts 14 beneath the cap 12 permit adjustment of the pressure on the spring 11 and the float 10. End caps 15 are also provided at the bottom and top ends of the float 10, so that the float is freely slidable on the inlet duct 7.

The top end of the inlet duct 7 is connected by a coupling 16 to a packer body 17 at the level of the bottom end of the inlet tubing 5. The packer body 17 forms a continuation of the inlet duct 7 and is provided with annular packers 18 for centering the packer body in the inlet tubing 5 and preventing the passage of well fluid into the area between the inlet and outlet tubing 5 and 6, respectively. The top end of the packer body 17 is provided with an annular flange 19, which rests on a shoulder 20 on the interior surface of the inlet tubing 5. The upper end of the packer body 17 is connected to a suction pipe 21 by an internally threaded coupling 22. The top end of the suction pipe 21 is connected to an ejector device generally indicated at 23. The annulus 21 (*a*), provides space for the accumulation of foreign particles which fail to pass through the passages 36.

Figure 3:
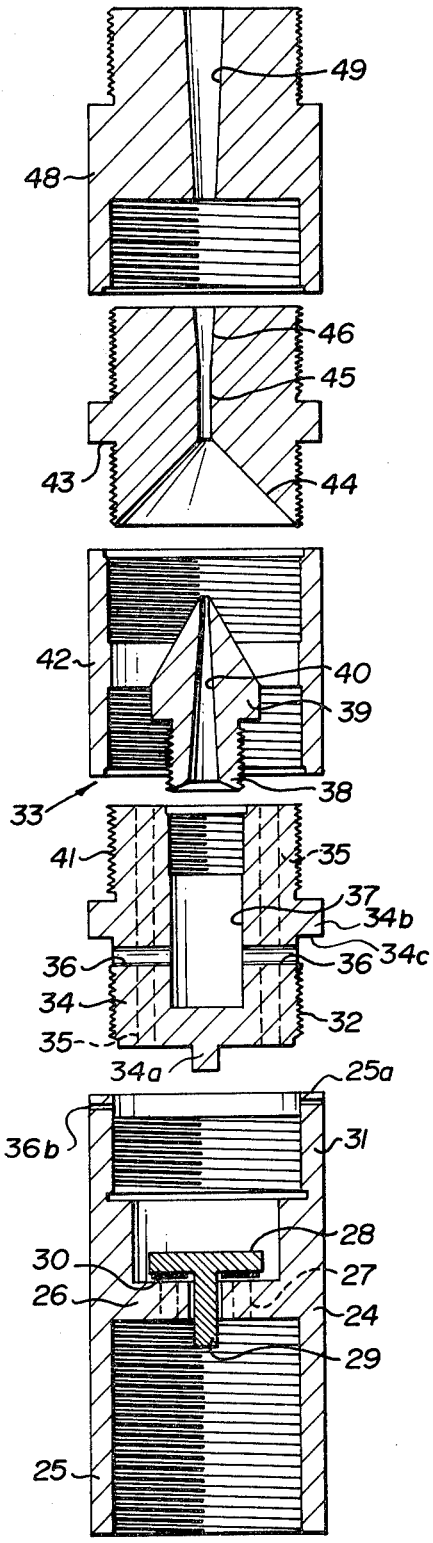
FIGS. 3 and 4 are cross-sectional views of elements of the system of FIGS. 1 and 2 on a scale of 1—1.
Figure 4:
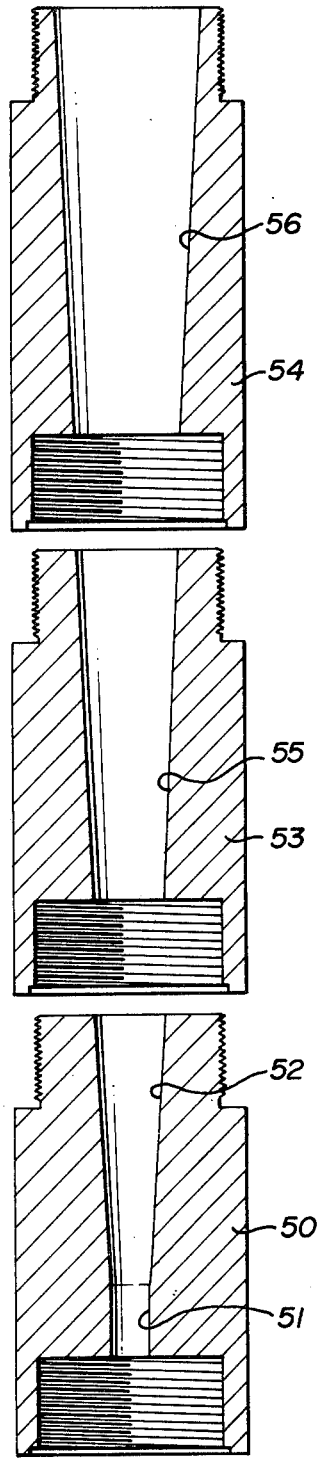

As shown in detail in FIGS. 2 to 4, the ejector device 23 includes a foot valve including a cylindrical valve body 24 with an internally threaded bottom end 25 for connecting the foot valve to the suction pipe 21. The foot valve is provided with a circular valve seat 26 in the longitudinal centre thereof, with a plurality of passages 27 therethrough defining a circle around the centre of the valve seat for the passage of well water into the ejector device. The passages 27 are closed by disc-shaped valve member 28, including a stem 29 slidably retaining the valve member in the valve seat 26, and a Teflon (a registered trade mark for polytetrafluoroethylene) washer 30. Travel of valve member 28 is limited by stop means 34(*a*) provided as an extension of body 34. Internally threaded top end 31 of the valve body 24 is connected to externally threaded bottom end 32 of a nozzle device generally indicated at 33.

The nozzle device 33 includes a tubular body 34 closed at its bottom end. A plurality of longitudinally extending passages 35 are provided in the body 34 of the nozzle device permitting the flow of well fluids through the body. The passages 35 are spaced equidistant apart around the periphery of the body 34, with radially extending passages 36 between each pair of longitudinal passages 35. The passage 36 permit the flow of drive fluid (water) into central chamber 37 of the nozzle device.

In order that sufficient water reaches passages 36, a water ingress slot 36(*a*) and circumferential drillings 36(*b*) are provided. (FIG. 2(*a*)). This slot 36(*a*) is formed between the top face 25(*a*) of bottom end 25, and the lower face 34(*c*) of shoulder 34(*b*) of body 34 (FIG. 3), when the two components 34 and 25 are threadedly engaged.

The dimensions of the circumferential drillings through bottom end 25, and the slot 36(*a*) so formed as indicated above are required to be of a size suitable to screen out particles of foreign materials which would otherwise tend to plug the discharge orifice 40.

The open top end of the body 34 is internally threaded for receiving threaded bottom end 38 of a nozzle 39. The nozzle 39 includes an upwardly tapering discharge orifice 40. Top end 41 of the tubular body 34 is externally threaded for connecting the nozzle device 33 to an internally threaded coupling sleeve 42, the top end of which is connected to a Venturi element 43.

The Venturi element 43 includes a longitudinally extending passage defined by a conical bottom portion 44 followed by a cylindrical central portion 45 and an upwardly flaring top portion 46.

A suction chamber 47 (FIG. 2*a*) is located between the conical bottom portion 44 of the Venturi element 42 and conical top surface of the nozzle 39. The cylindrical central portion 45 of the passage through the Venturi element performs as a Venturi throat during the flow of fluid therethrough. A first diffuser 48 is mounted on the top end of the Venturi body 42. The diffuser 48 includes an upwardly flaring passage 49, which with the top portion 46 of the passage through the Venturi body 43, performs as a first stage diffuser. A second or intermediate diffuser 50 is mounted on the top end of the diffuser 48. The diffuser 50 is provided with a passage having a cylindrical lower portion 51 and an upwardly flaring upper portion 52. The intermediate diffuser is followed in the upward or discharge direction by a second stage diffuser defined by a pair of diffuser bodies 53 and 54, which have upwardly flaring passages 55 and 56, respectively. The passages 55 and 56 and the upper portion 52 of the passage through the diffuser 50 define a continuous inverted frusto-conical passage, which is followed by piping defining the remainder of the outlet tubing 6.

The outlet tubing 6 extends upwardly through a packing 57 and cap 58 on the top end of the inlet tubing 5 to a gas separator 59 where any gas entrained in the water is separated. The packing 57 is a seal using packing material and a compression gland for preventing water leakage. In the present case, using $2\frac{3}{8}$ inch inlet tubing 5 and 1 inch outlet tubing 6, a standard oil field packer assembly is utilized although $2\frac{7}{8}$ inch inlet tubing and 1 to $1\frac{1}{2}$ inch outlet tubing can be used. The water, with the gas removed, is fed from the separator 59 via a duct 60 to a storage tank 61. Excess water can be dumped through a discharge valve 62 in the duct 60. A vent valve 63 is provided in the top of the tank 61. Water from the tank 61 is either discharged through duct 64 for another use or fed through a duct 65 to a pump 66. The pump 66 is driven by a gas operated engine 67, which receives gas from the separator 59 via a duct 68, pressure reducing valves 69 and 70, and a gas regulator 71. Excess gas from the separator 59 is discharged via the duct 68 and a duct 72 for further processing. Of course, water from the pump 66 is the drive water referred to hereinbefore which is pumped into the inlet tubing 5 via an inlet duct 73. Junction 74 between the inlet duct 73 and the inlet tubing 5 is a 4-way T-joint, with one side 75 opposite the inlet duct 73 plugged by a plug 75.

In operation, a gas normally enters the casing 1 via the perforations 2 and is discharged for processing through the outlet duct 4 in the cap 3. A certain quantity of water enters casing 1 through the perforations 2 with the gas. As the gas pressure drops, some of the water collects in the bottom end of the casing 1. When the water level rises approximately to the level L, the float 10 rises exposing apertures 9 in the inlet duct 7. Float equilibrium is attained by using progressively increasing inlet areas as the float rises. Thus, the well water, with some gas entrained therein, enters the inlet duct through the apertures 9.

The system is initially primed by water from the storage tank 61 and the pump 66. The foot valve member 28 prevents the downward flow of water during priming or whenever the ejector device 23 is not operating. Drive water from the storage tank 61 is pumped under pressure through the duct 73 into the inlet tubing 5, and enters the nozzle device 33 through the radially extending passages 36. The drive water enters the chamber 37 of the nozzle device 33 and is discharged through the nozzle orifice 40 into the Venturi element 43. During passage of the drive water through the suction chamber 47, a partial vacuum is created in such chamber, whereby well water is drawn from the inlet duct 7 through the packer body 17, the suction pipe 21, the foot valve passages 27 and the longitudinally extending passages 36 in the nozzle body 34 into the drive stream. The mixture of gas and water thus produced is driven upwardly through the venturi throat 45 into the diffusers 48, 50, 53 and 54. The use of more than one diffuser has advantages over the single stage diffuser common to known ejectors. The second stage diffuser 53, 54 results in the more complete recovery of pressure from the velocity head of the venturi throat. Single step diffusion requires a smaller discharge angle (less flare) in the diffuser passage, and consequently longer diffuser tubes than multi-stage diffusion. Because of the small Venturi throat diameter and the necessity of discharging into outlet tubing of at least 1 inch diameter, the diffuser cannot be made in one piece. By using short diffuser tubing with relatively few pieces, greater strength is achieved with the multi-stage diffusion of the present invention.

The mixture from the diffusers 48, 50, 53 and 54 is discharged via the outlet tubing 6 to the separator 59. As mentioned hereinbefore, gas from the separator 59 is either fed to the engine 67 for driving the pump 66, or discharged through the ducts 68 and 72 for processing. Normally, the quantity of gas collected from the separator 59 is more than sufficient to power the engine 66. Water from the separator is fed to the storage tank 61, and either returned to the pump 66 via duct 65 or discharged through the duct 64 for another use, i.e. produced water in excess of the capacity of the storage tank 51 and recirculation requirements overflows through the duct 64 and, if possible, is sold or otherwise re-used.

It will be appreciated that many variations in material and structure are possible. For example, the outlet tubing 6 may be standard steel pipe in short (e.g. 30') length of Flextube (a non-registered name for continuous flexible tubing) in one continuous piece. Present installations include Flextube 1" diameter outlet tubing with setting depths of 2729 feet. Installation and removal time for the ejector device and float valve using such tubing at 2720 feet is less than 1 hour. It will also be understood that whenever necessary, O-Rings or equivalent sealing arrangements are utilized.

Further modifications and alternative embodiments of the invention will be apparent to those skilled in the art in view of the foregoing description. Accordingly this description is to be construed as illustrative only and is for the purpose of teaching those skilled in the art the manner of carrying out the invention. It is further understood that the form of the invention herewith shown and described is to be taken as the presently preferred embodiment. Various changes may be made in the shape, size and general arrangement of components. For example equivalent elements may be substituted for those illustrated and described herein, parts may be used independently of the use of other features, all as will be apparent to one skilled in the art after having the benefits of the description of the invention.

I claim:

1. A water removal pump system for use in a gas producing well of the type including a casing defining the wall of the well, a cap on said casing defining the well head, and perforations in said casing near the bottom end thereof for introducing a well fluid comprising gas, water, or mixtures thereof into the casing, said system comprising inlet tubing within said casing extending from beneath said perforations through said cap at the well head for introducing a drive liquid into the well; outlet tubing within said inlet tubing extending from the well head downwardly beneath the bottom end of said inlet tubing into the casing for carrying said well fluid to the well head; sealing means between the bottom end of said inlet tubing and said outlet tubing for preventing the passage of said well fluid between said inlet and outlet tubing; a first valve in the bottom end of said outlet tubing for admitting said well fluid into said outlet tubing; a foot valve in said outlet tubing above said first valve permitting upward flow and preventing downward flow of said well fluid in said outlet tubing, an ejector device in said outlet tubing above said foot valve for mixing said well fluid with said drive fluid and directing said fluids upwardly to the well head; and pump means for continuously pumping said drive fluid into the space between said inlet and outlet tubing and through said ejector device for mixing with said well fluid to carry said well fluid to the well head.

2. A water removal pump system for gas wells of the type including a casing defining the wall of the well, a cap on said casing defining the well head, perforations in said casing near the bottom end thereof permitting the entry of gas into the casing and an outlet duct in said cap for discharging gas from the casing, said system comprising inlet tubing within said casing extending from beneath the perforations through said cap at the well head for introducing drive water into the well; outlet tubing within said inlet tubing extending through the cap at the well head downwardly beneath the bottom end of said inlet tubing into the casing for carrying well water introduced into the casing with the gas to the well head; sealing means between the bottom end of said inlet tubing and said outlet tubing for preventing the passage of well water and gas between said inlet and outlet tubing; a first valve in the bottom end of said outlet tubing for admitting well water into said outlet tubing; a foot valve in said outlet tubing above said first valve permitting upward flow and preventing downward flow of well water in said outlet tubing; an ejector device in said outlet tubing above said foot valve for mixing drive water and said well water and any gas contained therein, and directing said drive water, well water and gas upwardly to the well head; and pump means for continuously pumping said drive water into the passage between said inlet and outlet tubing and through said ejector device for mixing with said well water to carry the well water to the well head.

3. A pump system as claimed in claim 2, including a plurality of diffusers in said outlet tubing above said ejector device.

4. A pump system as claimed in claim 3, including a separator at the well head for receiving and separating water and gas from said outlet tubing, said pump means including a pump for receiving water from said separator and re-circulating the water through the inlet tube as drive water.

5. A pump system as claimed in claim 4, wherein said pump means includes a gas operated motor for operating said pump, and duct means for carrying gas from said separator to said motor, whereby the pump means is operated from gas separated from the water pumped out of the well.

6. A pump system as claimed in claim 2, 3 or 4 wherein said outlet tubing includes an inlet duct at the bottom end thereof, and apertures in said inlet duct for introducing well water into the outlet tubing; and said first valve is a float normally blocking said apertures, said float being movable by well water to open said apertures.

7. A pump system as claimed in claim 2, 3 or 4 wherein said ejector device includes a nozzle device including a tubular nozzle body with a closed bottom end, a plurality of longitudinally extending passages in said nozzle body permitting the flow of well water through the nozzle body, a central chamber in said nozzle body, a plurality of radially extending passages in said nozzle body between adjacent longitudinally extending passages for introducing drive water into said chamber, and a nozzle in the top end of said nozzle body for discharging drive water upwardly from the nozzle device; and a Venturi element above said nozzle device defining a suction chamber with the nozzle for mixing drive water from the nozzle with well water from the longitudinally extending passages.

* * * * *